US006412264B1

(12) United States Patent
De Josez et al.

(10) Patent No.: US 6,412,264 B1
(45) Date of Patent: Jul. 2, 2002

(54) LOW STRETCH ELEVATOR ROPE

(75) Inventors: Brigitte De Josez, Montreal; Joseph Misrachi, Cote St-Luc; Olivier Payant, Sainte-Therese, all of (CA)

(73) Assignees: Wire Rope Industries Ltd.; Industrie de Cables d'Acier Ltee, both of Montreal (CA)

( * ) Notice: Subject to any disclaimer, the term of this patent is extended or adjusted under 35 U.S.C. 154(b) by 0 days.

(21) Appl. No.: 09/913,493

(22) PCT Filed: Feb. 2, 2000

(86) PCT No.: PCT/CA00/00094

§ 371 (c)(1),
(2), (4) Date: Aug. 16, 2001

(87) PCT Pub. No.: WO00/50687

PCT Pub. Date: Aug. 31, 2000

(30) Foreign Application Priority Data

Feb. 23, 1999 (CA) ..... 2262307

(51) Int. Cl.[7] ..... D07B 1/06
(52) U.S. Cl. ..... 57/217; 57/223; 57/232
(58) Field of Search ..... 51/220, 221, 210, 51/217, 212, 218, 232, 237, 241, 223; 187/251

(56) References Cited

U.S. PATENT DOCUMENTS

| | | | | |
|---|---|---|---|---|
| 3,686,855 A | | 8/1972 | Falcy et al. | 57/145 |
| 3,705,489 A | | 12/1972 | Smollinger | 57/149 |
| 3,843,829 A | | 10/1974 | Bridges et al. | 174/36 |
| 4,022,010 A | * | 5/1977 | Gladenbeck et al. | 57/231 |
| 4,034,547 A | | 7/1977 | Loos | 57/146 |
| 4,120,145 A | | 10/1978 | Chiappetta et al. | 57/149 |
| 4,887,422 A | | 12/1989 | Klees et al. | 57/220 |
| 5,269,128 A | | 12/1993 | Walton et al. | 57/210 |
| 5,651,245 A | | 7/1997 | Damien | 57/220 |
| 5,797,254 A | | 8/1998 | Walton | 57/220 |
| 6,164,053 A | * | 12/2000 | O'Donnell et al. | 187/251 |
| 6,295,799 B1 | * | 10/2001 | Baranda | 57/210 |
| 6,321,520 B1 | * | 11/2001 | De Angelis | 57/211 |
| 6,334,293 B1 | * | 1/2002 | Poethke et al. | 57/210 |

FOREIGN PATENT DOCUMENTS

| | | | |
|---|---|---|---|
| CA | 1176998 | 10/1984 | 187/22 |
| CH | 689098 | 9/1998 | D07B/1/08 |
| WO | WO 0017441 | 3/2000 | D07B/1/16 |

* cited by examiner

*Primary Examiner*—Danny Worrell
(74) *Attorney, Agent, or Firm*—George J. Primak

(57) ABSTRACT

A low stretch elevator rope (10) is obtained in which a plastic core (12) has a central strength member (18) that does not increase the weight of the rope by more than 5%. Moreover, the plastic core (12) has a diameter exceeding 50% of the diameter of the rope (10), when measured prior to winding steel strands (14) onto the core (12). The steel strands (14) that are wound around the core (12) are conventional and are so wound that the plastic material of the core (12) essentially fills the inner interstices (16) between the steel strands (14).

10 Claims, 1 Drawing Sheet

LOW STRETCH ELEVATOR ROPE

BACKGROUND OF THE INVENTION

1. Field of the Invention

The present invention relates to a low stretch elevator rope. In particular it relates to an elevator rope having a reinforced plastic core and conventional steel strands wound around said core.

2. Description of the Prior Art

The elevator industry has adopted some standard elevator rope designs and size ranges based mostly on the use of a rope construction having a textile (e.g. sisal) core with outer steel strands wound thereon. Such conventional elevator ropes are also designed to have a predetermined weight per unit length for each rope size. This is because the elevator operation and functioning, such as required motor power, friction characteristics, payload that can be lifted, and so on, are based on such specific weight which usually can vary by ±5%, but not more unless the entire design of the elevator operation is to be modified.

The installation and use of such conventional sisal core ropes requires that their length be adjusted a short time after installation to compensate for their significant constructional stretch. Further readjustments are necessary during the life of the rope to compensate for additional stretch. If such adjustments are not made, the elevator cage will eventually not stop at the correct elevation. These length adjustments are quite expensive and may, in certain cases, be equal to or exceed the cost of the rope itself.

Several attempts have been made to reduce constructional stretch in elevator ropes. For example, in U.S. Pat. No. 4,887,422 of Dec. 19, 1989 it is stated that constructional stretch may be reduced by a factor of 2.5 times by providing a special construction of the core with a plurality of helically twisted high strength synthetic yarns that have a modulus about equal to that of the outer strands. This construction has not been widely adopted, probably due to the complexity and high cost of the proposed core design.

U.S. Pat. No. 3,686,855 of Aug. 29, 1972 provides a wire rope with a core made entirely of thermoplastic material rather than textile and indicates that one of its objects is to avoid substantial variation in the length and/or the diameter of the cable while in use. It would appear, however, that this construction was not found satisfactory for elevator applications, since such rope has not replaced the conventional sisal elevator rope which still remains the standard today.

Another way to reduce the stretch of an elevator rope is to replace the textile or plastic core with an independent wire rope core (IWRC). However, because of specific weight considerations discussed above, it is often not possible to replace standard elevator ropes by much heavier IWRC ropes, without a major re-design of the elevator system.

In order to reduce the weight of IWRC ropes, it is proposed in U.S. Pat. No. 5,651,245 of Jul. 27, 1997 to place the synthetic material within the outer strands. This, however, requires a special strand construction and the closing of the core and strands must be made in one operation to achieve a parallel lay condition between the outer rope strands and the core's outer strands, which is done to keep the core deterioration to a minimum. This, however, is a complex procedure that would substantially increase the manufacturing cost of the elevator rope.

OBJECTS AND SUMMARY OF THE INVENTION

It is an object of the present invention to provide a low stretch elevator rope having a reinforced plastic core, with conventional steel strands wound around such core.

Another object is to provide a low stretch elevator rope which has the weight per unit length not exceeding the acceptable ±5% variation over the specific weight of similar ropes with sisal cores.

A still further object of the present invention is the ability to manufacture such novel elevator rope in a simple and efficient manner.

Other objects and advantages of the invention will be apparent from the following description thereof.

In essence there is provided, in accordance with the present invention, an elevator rope having a plastic core, with conventional steel strands wound around said core and embedded into said core so that inner interstices between the strands are essentially filled with the plastic material of the core, and wherein the plastic core has a diameter exceeding 50% of the total diameter of the rope, and preferably at least 54%, when measured prior to winding the steel strands around said core, and further the core comprises a central strength member which reinforces the rope without increasing the weight per unit length by more than 5%, and preferably by less than 1%.

It has been surprisingly found that stretch of the elevator rope can be substantially reduced, usually by more than 60%, over standard sisal ropes of the same size, while increasing the strength of the rope, by dimensioning the reinforced plastic core so that when measured prior to closure, its diameter exceeds 50% of the total diameter of the rope after closure of the plastic core by winding conventional steel strands thereon and embedding them in the core. It has been found that when such diameter is less than 50%, the reduction in stretch of the rope is not significant. The plastic core of the novel construction of the rope also comprises a central strength member which not only assists in reducing the shrinkage of the rope, but also provides an improved strength or minimum breaking load increase when compared to the standard sisal rope, without significantly affecting its weight or dimensions. This central strength member can be, for example, a small steel strand or a steel wire or even a high tensile fiber, such as Kevlar® or Vectran®, however, it should be such as not to increase to overall weight per unit length of the rope by more than 5% which is considered a permitted limit in the industry for the variation of the specific weight of the elevator rope. In fact, preferably it should not increase such weight by more than 1%.

The plastic used for the core is usually a thermoplastic material, such as polypropylene, a medium or high density polyethylene or nylon, although other plastic materials that are suitable for such purposes, could also be used. Such plastic material would normally be extruded around the central strength member which also serves as a guiding member during the extrusion process to form the core of the novel rope construction, around which conventional steel strands are then closed in a conventional manner, thereby allowing use of conventional closing equipment.

Thus, the method of manufacturing the low stretch elevator rope of the present invention comprises:

(a) providing a strength member that would increase the minimum breaking load of the rope without increasing the weight per unit length by more than 5%, preferably by less than 1%;

(b) extruding a thermoplastic material around said strength member so as to form a plastic core having said strength member at its center, said plastic core being so dimensioned as to have a diameter exceeding 50%, and preferably at least 54%, of the total diameter of the rope; and (c) winding conventional steel strands around said plastic core and pressing them so that the thermoplastic material of the core essentially fills inner interstices between the steel strands in the rope thereby produced.

DETAILED DESCRIPTION OF THE INVENTION

In the figures, the same elements are designated by the same numerals.

Figure 1:
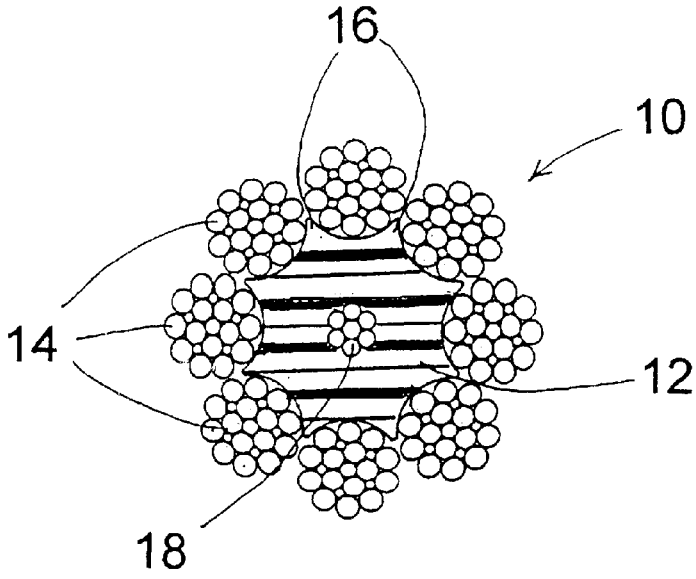
FIG. 1 is a section view of an elevator rope of the present invention.

Referring to FIG. 1, it shows a section of elevator rope 10 having a plastic core 12 with conventional steel strands 14 wound around core 12 and embedded in the core 12 so that the inner interstices 16 are essentially filled with the plastic material of core 12. In the center of the plastic core 12, there is provided a strength member 18, which in this case is a 1×7 steel strand.

Figure 2:
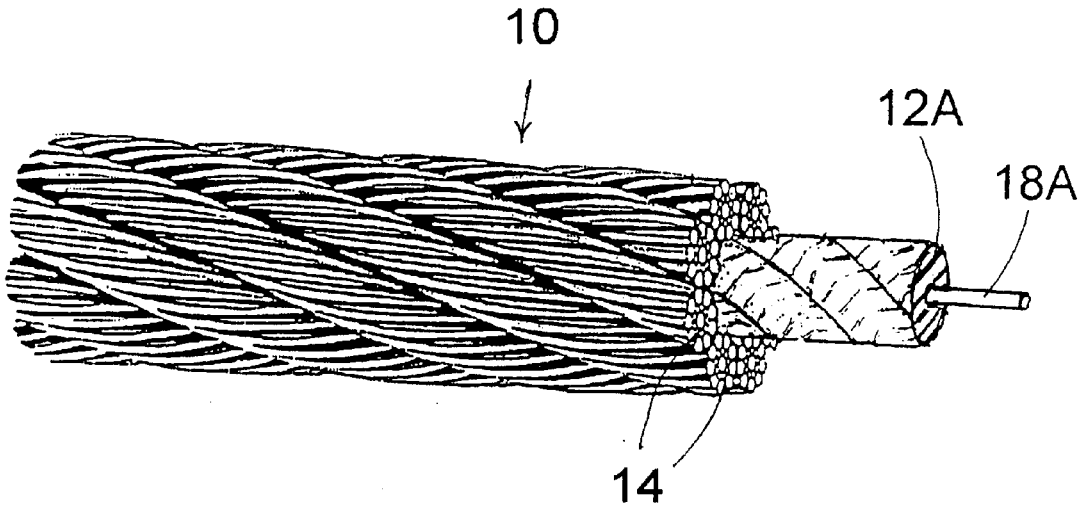
FIG. 2 is a view in perspective of the novel elevator rope, with cut-outs showing its various parts.

In FIG. 2 a similar construction is shown in perspective. Here, however, the strength member 18A is a steel wire instead of the steel strand shown in FIG. 1. The plastic jacket 12A extruded around the strength member 18A has a diameter which is over 50% of the total diameter of the rope 10. The measurement of the diameter of the jacket or core 12A is done prior to the closure of the core 12A by strands 14, which closure is such that said strands 14 are embedded in the core 12A by pressure or heat and pressure so that the inner interstices 16 between the strands 14 are essentially filled with the plastic material of core 12A, thereby modifying the round contour of core 12A into a star-like contour 12 shown in FIG. 1.

In the best mode example, a rope with a nominal diameter of ½" (13.03 mm) was produced in accordance with this invention, whereby a polypropylene jacket was extruded around a 1×7 steel strand. This resulted in a weight per foot increase of 0.5% of the overall rope. This central steel strand also produced a minimum breaking load increase of 4%. The extruded core had a diameter of 0.288" (7.31 mm) or 54% of the final rope diameter, when measured prior to the closure of the rope with conventional steel strands.

The obtained rope was subjected to a reverse bend fatigue test using a load of 1000 lbs (6.5% of minimum breaking load). After 200,000 cycles the average permanent elongation of the novel rope was found to be 0.16%. Using the same procedure on a ½" standard rope with sisal core an average elongation of 0.43% was obtained after 200,000 cycles on the reverse bend fatigue machine. Thus, the rope of the present invention produced a reduction in elongation of 63% over the standard sisal core rope while still using conventional outer strands and having a weight increase of a mere 0.5%.

It should be noted that the invention is not limited to the above best mode embodiment, but that various modifications, obvious to those skilled in the art, can be made without departing from the spirit of the invention and the scope of the following claims.

What is claimed is:

1. A low stretch elevator rope having a plastic core, with conventional steel strands wound around said core and embedded into said core so that inner interstices between the strands are essentially filled with the plastic material of the core, characterized in that said plastic core has a diameter exceeding 50% of the total diameter of the rope, when measured prior to winding the strands around said core, and further said core comprises a central strength member which reinforces the rope without increasing the weight per unit length of the rope by more than 5%.

2. A low stretch elevator rope in which said diameter of the plastic core is at least 54% of the total diameter of the rope.

3. A low stretch elevator rope according to claim 1, in which said central strength member does not increase the weight per unit length of the rope by more than 1%.

4. A low stretch elevator rope according to claim 1, in which said central strength member is a steel strand.

5. A low stretch elevator rope according to claim 1, in which the plastic material is extruded around the strength member to form the core and subsequently conventional steel strands are wound around said core and embedded thereinto to form the elevator rope.

6. Method of manufacturing a low stretch elevator rope, comprising:

(a) providing a strength member that would not increase the weight per unit length of the rope by more than 5%;

(b) extruding a thermoplastic material around said strength member so as to form a plastic core having said strength member at its center, said plastic core being so dimensioned as to have a diameter exceeding 50% of the total diameter of the rope; and (c) winding conventional steel strands around said plastic core and pressing them so that the thermoplastic material of the core essentially fills inner interstices between the steel strands in the rope thereby produced.

7. Method according to claim 6, in which the strength member is such that the weight per unit length of the rope does not increase by more than 1%.

8. Method according to claim 6, in which the strength member is a steel strand.

9. Method according to claim 6, in which the plastic core has a diameter of at least 54% of the total rope diameter when measured prior to winding the steel strands around said core.

10. Method according to claim 6, in which the strength member also serves as a guiding member during the extrusion process.

* * * * *